US008506267B2

(12) United States Patent
Gambier et al.

(10) Patent No.: US 8,506,267 B2
(45) Date of Patent: Aug. 13, 2013

(54) PUMP ASSEMBLY

(75) Inventors: Philippe Gambier, Houston, TX (US); Laurent Coquilleau, Houston, TX (US); Edward Leugemors, Sugar Land, TX (US); Jean-Louis Pessin, Houston, TX (US); Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1091 days.

(21) Appl. No.: 12/203,604

(22) Filed: Sep. 3, 2008

(65) Prior Publication Data

US 2009/0068031 A1 Mar. 12, 2009

Related U.S. Application Data

(60) Provisional application No. 60/971,090, filed on Sep. 10, 2007.

(51) Int. Cl.
*F04B 23/04* (2006.01)
*F04B 41/06* (2006.01)
*F04B 3/00* (2006.01)

(52) U.S. Cl.
USPC ..... 417/429; 417/244

(58) Field of Classification Search
USPC ..... 166/244.1; 417/429
See application file for complete search history.

(56) References Cited

U.S. PATENT DOCUMENTS

| | | | | |
|---|---|---|---|---|
| 3,891,354 | A | 6/1975 | Bosch | |
| 3,988,892 | A | 11/1976 | Bosch | |
| 4,341,508 | A | 7/1982 | Rambin, Jr. | |
| 5,165,862 | A | 11/1992 | Lindblom | |
| 5,730,871 | A | 3/1998 | Kennedy et al. | |
| 5,775,881 | A | 7/1998 | Stich | |
| 6,070,661 | A | 6/2000 | Kennedy et al. | |
| 6,109,894 | A | 8/2000 | Chatelain | |
| 6,702,011 | B2 | 3/2004 | Crawford et al. | |
| 7,051,818 | B2 | 5/2006 | Crawford et al. | |
| 7,207,381 | B2 | 4/2007 | Sharp | |
| 2003/0074896 | A1 * | 4/2003 | Linster et al. | 60/477 |
| 2004/0244993 | A1 * | 12/2004 | Crawford et al. | 166/381 |
| 2008/0066915 | A1 | 3/2008 | Shampine | |
| 2008/0152517 | A1 * | 6/2008 | Ishii et al. | 417/423.5 |
| 2009/0050311 | A1 * | 2/2009 | Crawford | 166/90.1 |
| 2009/0214372 | A1 * | 8/2009 | Mcguffey et al. | 418/200 |

* cited by examiner

*Primary Examiner* — Anh Mai
*Assistant Examiner* — Michael Santonocito
(74) *Attorney, Agent, or Firm* — Myron Stout; Daryl Wright; Tim Curington

(57) ABSTRACT

A technique facilitates the pumping of fluids in a well related application while minimizing the number of system components. The system and methodology comprise a plurality of pumps for use at a well site to deliver a well treatment fluid to a desired location. A single driveline is coupled between the plurality of pumps and a motive unit without incorporating a splitter box. The driveline is driven by the motive unit to rotate the plurality of pumps.

34 Claims, 3 Drawing Sheets

PUMP ASSEMBLY

CROSS-REFERENCE TO RELATED APPLICATION

The present document is based on and claims priority to U.S. Provisional Application Ser. No. 60/971,090, filed Sep. 10, 2007, the disclosure of which is incorporated by reference herein in its entirety.

BACKGROUND

A variety of systems and methods are used for pumping fluids in many well related applications. In well treatment operations, for example, one or more surface pumps are used to pump the treatment fluids, such as fracturing fluids, cementing fluids, gravel packing slurries, and other fluids to a desired formation or other subterranean region. In many of these applications, substantial amounts of fluid are directed downhole under pressure to perform the desired well related treatment.

During the pumping operation, more than one pump may be employed to obtain the desired flow, pressure, and/or redundancy. In applications where more than one pump is utilized, more than one engine must be employed to drive the pumps or the output of a single-engine must be run through a splitter box which splits the engine output to a plurality of splitter box output shafts. In one prior arrangement, a single engine is coupled to a splitter box which, in turn, drives two transmissions. Each transmission is coupled to and drives a corresponding pump. In another prior arrangement, a single-engine is connected to a transmission which, in turn, is coupled to a splitter box. The separate output shafts of the splitter box are coupled to and drive corresponding pumps. However, such prior systems are costly because of the required number of expensive components, including a splitter box and/or multiple transmissions and multiple engines.

SUMMARY

In general, the present invention provides a system and method for pumping fluids in a well related application while minimizing the number of system components. The system and methodology comprise a plurality of pumps for use at a well site to deliver a well treatment fluid to a desired location. A single driveline is coupled between a motive unit and the plurality of pumps without incorporating a splitter box. The driveline is driven by the motive unit to rotate the plurality of pumps.

A system for pumping comprises a mobile platform, a motive unit mounted on the mobile platform, a plurality of pumps mounted on the mobile platform, and a drive shaft forming a driveline driven by the motive unit, the drive shaft being coupled with a solid, direct connection to the plurality of pumps without splitting the driveline. The motive unit may comprise one of an internal combustion engine, a gas turbine, an electric motor, and a hydraulic motor. Alternatively, the system further comprises a transmission coupled to the internal combustion engine and to the drive shaft. Alternatively, the plurality of pumps comprises two pumps.

Alternatively, the plurality of pumps comprises more than two pumps. Alternatively, each pump of the plurality of pumps comprises a positive displacement pump. Alternatively, the drive shaft extends through a first pump to a second pump. Alternatively, the drive shaft comprises an external drive shaft being directly coupled to each pump of the plurality of pumps by a gear. Alternatively, the system further comprises a pump release system to enable selective release of an individual pump from a pumping operation. Alternatively, the mobile platform is one of a truck trailer, a skid, and a self-propelled platform.

In an embodiment, a method of delivering a well treatment fluid comprises providing a plurality of pumps at a well site, coupling a single driveline directly to the plurality of pumps without a splitter box, engaging the driveline with the motive unit for rotating the driveline and powering the plurality of pumps, and delivering a well treatment fluid downhole to perform at least one well treatment operation. Alternatively, delivering comprises delivering one of a fracturing treatment fluid, a cementing treatment fluid, and a coiled tubing service fluid. Alternatively, providing comprises providing a plurality of positive displacement pumps. Alternatively, coupling comprises coupling a drive shaft with a solid, direct connection to the plurality of pumps so that the drive shaft extends through at least one pump. Alternatively, coupling comprises coupling a drive shaft with a solid, direct connection to the plurality of pumps so that the drive shaft is disposed externally of the plurality of pumps.

Alternatively, engaging comprises connecting the driveline to one of an internal combustion engine, a gas turbine, an electric motor, and a hydraulic motor. Alternatively, the method further comprises using a pump release system in cooperation with the plurality of pumps to enable selective release of an individual pump from a pumping operation via a mechanical disconnect of the individual pump. Alternatively, the method further comprises using a pump release system in cooperation with the plurality of pumps to enable selective release of an individual pump from a pumping operation via a hydraulic rerouting system. Alternatively, the method further comprising mounting the plurality of pumps and the motive unit on a mobile platform.

In an embodiment, a system comprises a plurality of pumps mounted at a surface location for use in delivering treatment fluid downhole in a well treatment operation, a motive unit, a single shaft coupling the motive unit to the plurality of pumps without splitting the single shaft, and a pump release system selectively operable to release individual pumps from delivering treatment fluid downhole. Alternatively, the pump release system comprises a mechanical release system. Alternatively, the pump release system comprises a hydraulic rerouting system. Alternatively, the system further comprises at least one mobile platform, wherein the plurality of pumps and the motive unit are mounted on the mobile platform.

Alternatively, the system further comprises at least two mobile platforms, wherein the plurality of pumps are mounted on a mobile platform and the motive unit is mounted on a separate mobile platform. Alternatively, the single shaft is coupled to the plurality of pumps via pinion gears. Alternatively, the single shaft is coupled to the plurality of pumps via a transfer case. Alternatively, the pump release system comprises a plurality of valves to selectively stop flow of the treatment fluid to or from the pumps. Alternatively, the pump release system is connectable such that an angle of rotation between the pumps is selectable.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of embodiments of the present invention. However, it will be understood by those of ordinary skill in the art that the present invention may be practiced without these details and that numerous variations or modifications from the described embodiments may be possible.

Embodiments of the present invention generally relates to a system and method for pumping fluid in a variety of well related applications. The system and methodology may utilize pumps positioned at a surface location to pump selected treatment fluids downhole. For example, the pumping system can be used to pump fracturing fluids, cementing fluids, and other well treatment fluids downhole for performance of a given well related operation.

The design of the pumping system eliminates the need for expensive components, such as a splitter box, additional transmissions, and additional engines. Furthermore, the system and methodology provide for smoother torque variations on the transmission used in the pumping system. In some embodiments, the position of the cranks between pumps is movable during assembly and fixed once assembled for a pumping application. The pumping system also enables at least partial redundancy. In these applications, selected pumps can be released from the pumping operation by, for example, disconnection from the driveline or by separating the output flow from the discharge piping. The pumping system design enables the number of pumps to be increased without adding substantial complexity.

Figure 1:
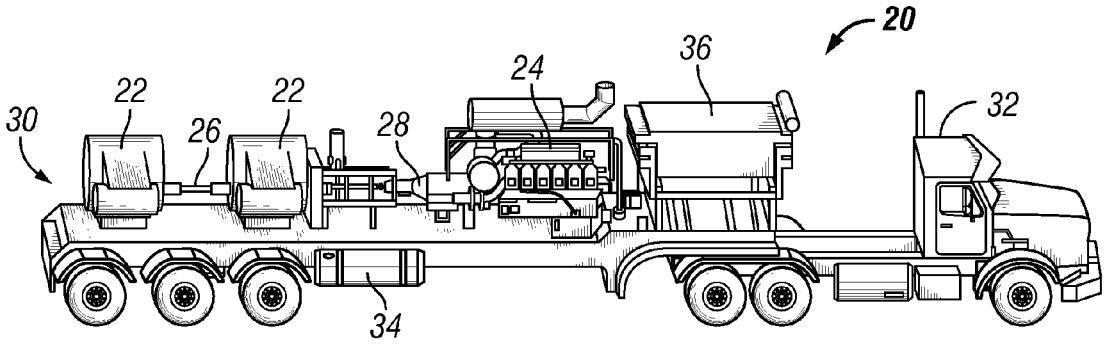
FIG. 1 is an illustration of an embodiment of a truck trailer mounted pumping system.

Referring generally to FIG. 1, one example of an embodiment of a pumping system 20 is illustrated. In this example, the pumping system 20 is a transportable system that may be transported over the highway system to a given job site. As illustrated, pumping system 20 is a truck trailer mounted system having a plurality of pumps 22. The pumping system 20 may comprise two pumps 22 or more than two pumps 22 depending on the requirements of a given well related operation. For example, additional pumps 22 can be added to meet increased flow volume, pressure, redundancy and other requirements for a well treatment operation or other well related operation.

As illustrated in FIG. 1, pumping system 20 further comprises a motive unit 24 coupled to pumps 22 via a driveline 26. The motive unit 24 may provide power to rotate driveline 26 and thus pumps 22 through a transmission 28. Driveline 26 may comprise a drive shaft that is coupled to the plurality of pumps 22 via a solid, direct connection without splitting the driveline. The solid, direct connection of driveline 26 to pumps 22 enables the transfer of substantial power from motive unit 24 to the pumps 22. In the embodiment illustrated, motive unit 24 comprises an internal combustion engine connected directly to transmission 28. Alternatively, motive unit 24 is a turbine, an electric motor, a hydraulic motor, or similar apparatus suitable for driving the pumps 22.

In the embodiment of FIG. 1, the plurality of pumps 22 and motive unit 24 are mounted on a mobile platform 30 such as, but not limited to, a truck trailer 30. By way of example, truck trailer 30 may comprise a flatbed trailer designed for movement from one well location to another by a suitable tractor 32. Additional components, such as fuel tanks 34 or storage tanks 36, also can be mounted on truck trailer 30. The overall pumping system 20 comprises a simple, movable pumping system having a single engine, or other motive unit, and a single transmission to drive the plurality of pumps. Alternatively, pumping system 20 is a self-propelled system mounted on, for example, a truck or similar self-propelled vehicle, as will be appreciated by those skilled in the art. Alternatively, the mobile platform 30 is a skid or similar structure suitable for being transported via land vehicles (such as a removable mount to a truck trailer), waterborne vessels (such as a removable mount to a ship, barge, or the like), or air vehicles (such as a removable mount to an airplane or helicopter or suitable for lifting by a helicopter), as will be appreciated by those skilled in the art.

Figure 2:
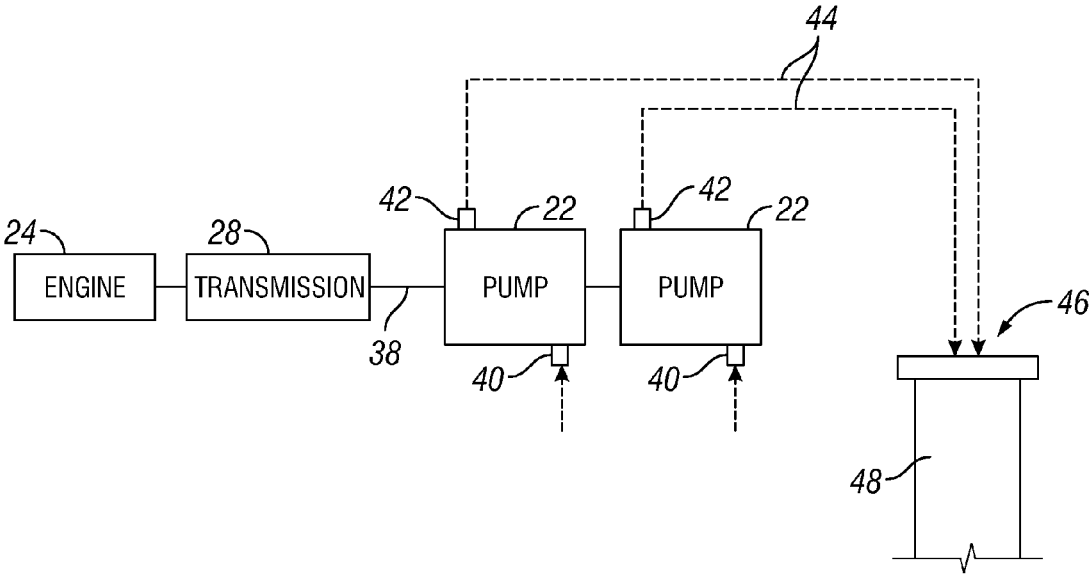
FIG. 2 is a schematic illustration of one example of an embodiment of a pumping system for delivering treatment fluid.

The motive unit 24, transmission 28 and pumps 22 may be directly connected in several configurations. As illustrated in FIG. 2, for example, the motive unit 24 comprises an engine directly connected to transmission 28 which, in turn, is directly connected to the plurality of pumps 22 by a drive shaft 38. In this embodiment, the motive unit 24 comprises an engine driving at least two pumps 22 without splitting the driveline via, for example, a splitter box. The multiple pumps 22 are driven by the same drive shaft 38, and the drive shaft 38 extends through at least some of the pumps 22 and/or one or more components of the pumps 22. For example, the drive shaft 38 may extend through at least the first pump 22 to the second pump 22 to drive both and/or each of the pumps.

In other configurations, pumping system 20 comprises more than two pumps 22 with the drive shaft extending directly through two or more pumps to the final pump. By way of example, a single drive shaft passing through the pumps and/or one or more components of the pumps 22 may be used. In an alternate example, the input shaft of each pump is sequentially connected to the input shaft of the next pump, e.g. the crankshafts of the plurality of pumps are linked. Regardless, the drive shaft 38 forms a solid, direct connection with each pump 22 by mechanically engaging each pump. The direct, mechanical connection facilitates the transfer of power from the motive unit 24 even under high load pumping conditions. The drive shaft 38 preferably maintains a fixed relationship between the angle of rotation of the shafts of the pumps 22 such that the pumps 22 are rotated in a synchronous manner.

Pumps 22 may comprise a variety of pump types, however positive displacement pumps are useful in many pumping applications. Examples of such pumps include duplex pumps, triplex pumps, quintuplex pumps, sixtuplex pumps and septuplex pumps. The positive displacement pumps are useful in a variety of well treatment operations including, but not limited to, fracturing operations and cementing operations. When conducting a treatment operation, motive unit 24 rotates drive shaft 38 to drive pumps 22 which, in turn, draw treatment fluid into the pumps 22 through corresponding inlets 40. The treatment fluid is pumped and discharged through corresponding pump outlets 42. From outlets 42, the treatment fluid is directed along an appropriate flow path 44 including, but not limited to, a path via jointed tubing, coiled tubing or the like, to a well 46 to be treated. For example, the treatment fluid may be directed downhole into a wellbore 48 to a desired well treatment region that is to be fractured, cemented or otherwise treated, such as with gravel packing slurries, coiled tubing service fluids and/or other fluids, as will be appreciated by those skilled in the art.

Figure 3:
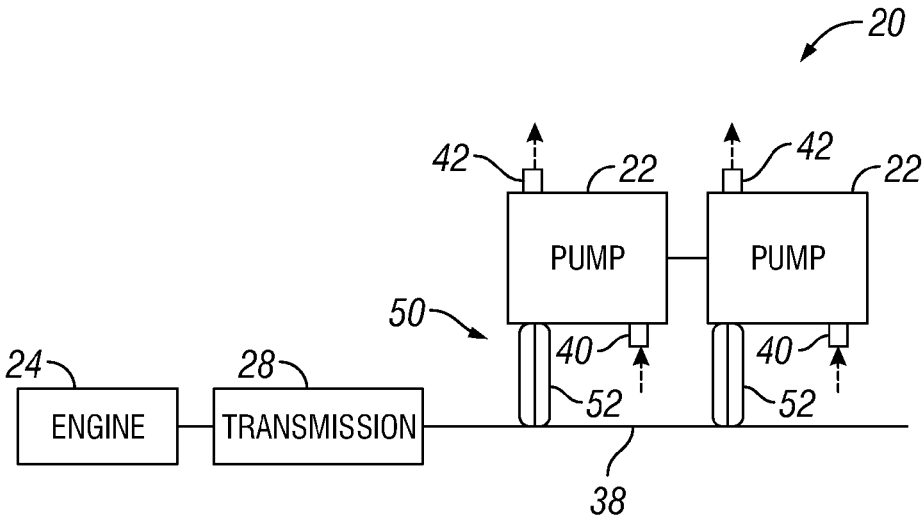
FIG. 3 is a schematic illustration of another example of an embodiment of a pumping system for delivering treatment fluid.

Another embodiment of pumping system 20 is illustrated in FIG. 3. In this embodiment, pumps 22 are again arranged in series and the solid, direct connection between drive shaft 38 and pumps 22 is achieved with the drive shaft 38 located in a position external to the two or more pumps 22. The solid, direct connection between drive shaft 28 and pumps 22 may be formed with a gear system 50. For example, a gear, such as a pinion gear 52, may be connected between drive shaft 38 and each pump 22. The gear 52 can be mounted on or engaged with drive shaft 38 to directly drive an input shaft of each pump or to directly drive gears engaging the input shaft of each pump 22.

Figure 4:
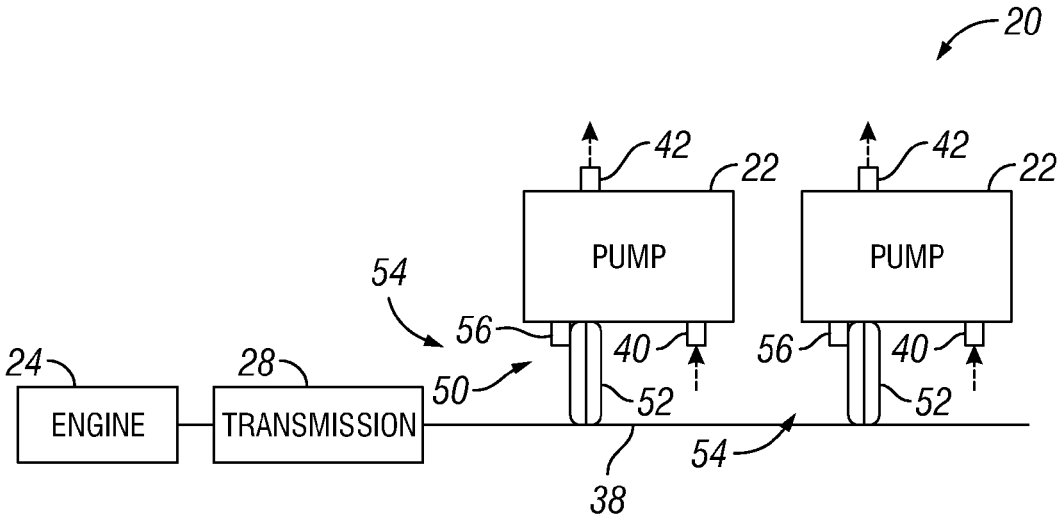
FIG. 4 is a schematic illustration of another example of an embodiment of a pumping system for delivering treatment fluid.

The pumping system 20 also may be designed with a pump release system 54, as illustrated in FIG. 4. The pump release system 54 is designed to enable selective release of individual pumps from a pumping operation. For example, individual pumps 22 can be released from participation in a given well treatment operation when, for example, pumping requirements change, equipment malfunctions occur, a redundant system is desired, or other factors arise requiring release or removal of one or more pumps 22 from the well operation.

In the embodiment illustrated in FIG. 4, pump relief system 54 comprises a mechanical release 56 associated with each pump 22. Each mechanical release 56 may be manually controlled or controlled by an actuator, such as a solenoid, a hydraulic actuator, or other suitable actuator. Actuation of a selected mechanical release 56 disconnects the corresponding pump 22 from shaft 38 to enable continued rotation of shaft 38 without operation of the corresponding pump 22. The mechanical release 56 may comprise a variety of coupling members that couple drive shaft 38 to the pumps 22. For example, the mechanical release may comprise a pin, a key, a hydraulic lock, or other features that enable decoupling of shaft 38 from a specific pump 22, such as, but not limited to, a clutch or the like. The mechanical release 56 can be located externally or internally with respect to each pump 22 depending on whether shaft 38 extends through the interior of pumps 22 or along the exterior. In external shaft embodiments, for example, the mechanical release 56 may comprise a coupling member located to couple the pinion gear 52 with its corresponding pump 22.

Figure 5:
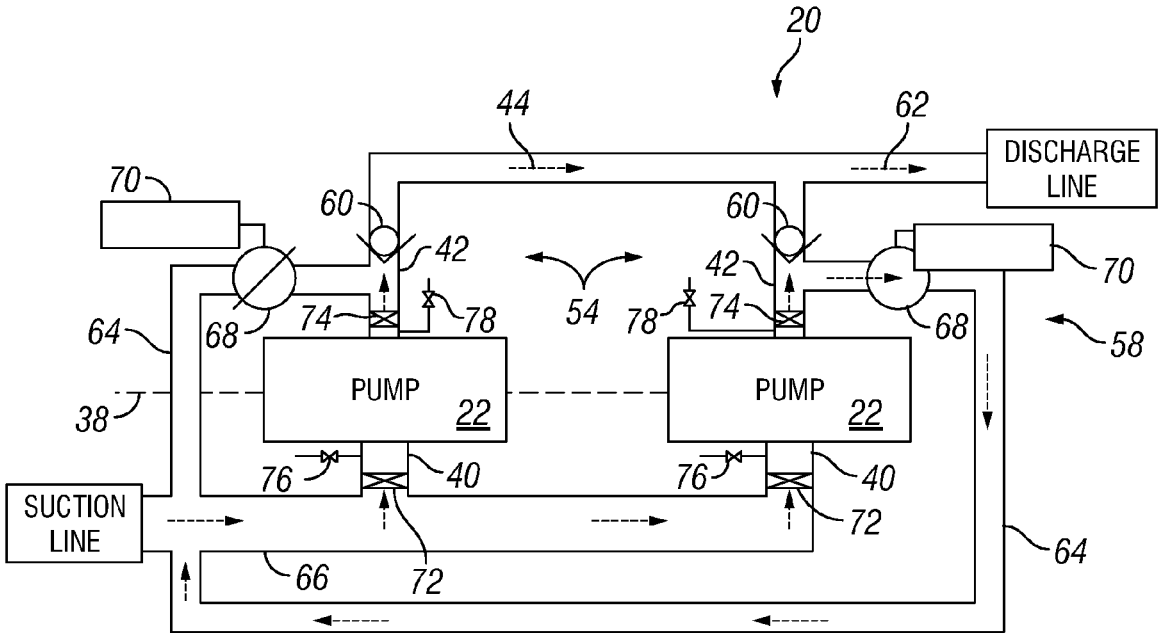
FIG. 5 is a schematic illustration of another example of an embodiment of a pumping system for delivering treatment fluid.

An embodiment of pump release system 54 is illustrated in FIG. 5. In this embodiment, the pump release system 54 does not comprise a mechanical disconnect but rather features a hydraulic rerouting system 58 which is used to redirect fluid discharged through the outlet 42 of a specific pump 22. According to one example, the hydraulic rerouting system 58 enables the discharge pressure of a select pump or pumps to be injected into the suction side of the pumping system 20 to prevent participation of the selected pump or pumps 22 in the specific well treatment operation.

In the embodiment illustrated, the hydraulic rerouting system 58 comprises a check valve 60 disposed in the outlet 42 of each pump 22. The check valves 60 allow one-way flow of fluid to flow path 44 which may be along a discharge line 62 that ultimately directs the discharged fluid downstream, such as to the wellbore 48 shown in FIG. 2. Each check valve 60 blocks back-flow of fluid from discharge line 62 to the corresponding pump 22. The hydraulic rerouting system 58 further comprises a fluid rerouting line 64 for each pump 22. Each fluid rerouting line 64 is connected to one of the outlets 42 between the check valve 60 and its corresponding pump 22 to enable rerouting of fluid flow discharged from the corresponding pump 22 to a suction line or intake line 66. The suction line 66 is connected to the intake or inlets 40 of all of the pumps 22.

A valve 68 is disposed along each fluid rerouting line 64 and may be controlled by an appropriate actuator 70. For example, each valve 68 may be selectively moved between a flow position (see valve on right side of FIG. 5) and a no-flow position (see valve on left side of FIG. 5). As illustrated by the valve 68 on the right side of FIG. 5, positioning the valve 68 in an open or flow position enables fluid discharged from the corresponding pump 22 to be rerouted through fluid rerouting line 64 and into suction line 66. If, however, valve 68 is closed as illustrated on the left side of FIG. 5, fluid is forced through the corresponding check valve 60 and into discharge line 62. The check valves 60 further prevent the cross flow of fluid from one pump to the discharge side of another pump.

Alternatively, one or the other of the pumps 22 may be unloaded and/or shut down by removing the suction supply, such as by shutting a suction valve 72 disposed in the inlet 40 of the pump 22. Alternatively, a pump 22 may be unloaded and/or shut down by closing a discharge valve 74 disposed in the outlet 42 of the pump 22. Alternatively, a pump 22 may be unloaded and/or shut down by opening the pump 22 to atmosphere closing the suction valve 72 and discharge valve 74 and opening a vent valve 76 disposed in the inlet 40 and/or a vent valve 78 disposed in the outlet 42 of the pump 22.

Figure 6:
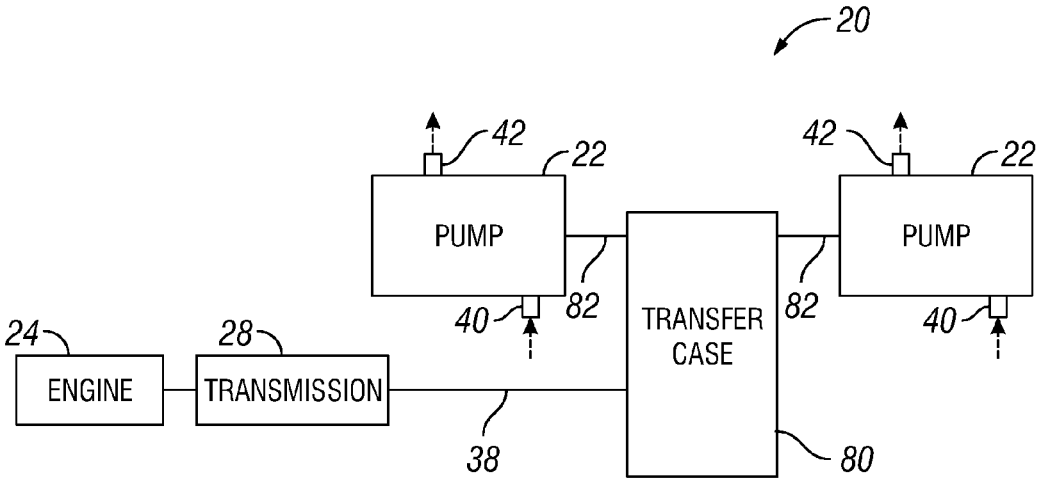
FIG. 6 is a schematic illustration of another example of an embodiment of a pumping system for delivering treatment fluid.

Another embodiment of pumping system 20 is illustrated in FIG. 6. In this embodiment, pumps 22 are again arranged in series and the solid, direct connection between drive shaft 38 and pumps 22 is achieved with the drive shaft 38 connected to a two output shaft transfer case or drop box 80, wherein the drive shaft 38 is in direct connection a gear (not shown) in the transfer case 80, and the gear in the transfer case 80 is directly connected with a drive shaft 82 drives either or both of the pumps 22. The gears in the transfer case 80 are preferably substantially similar in size to enable the drive shaft 82 to drive the pumps 22 as if the pumps 22 were directly connected to the drive shaft 38. The pumps 22 may be connected and disconnected from the shaft 82, such as with the pump disconnect system 54 shown in FIG. 4, with a clutch, or similar device, as will be appreciated by those skilled in the art.

As described above, pumping system 20 can be constructed in a variety of configurations for use in many environments and applications. The various configurations can be mounted for transport on a mobile platform such as a truck trailer 30 or on other mobile platforms, including on a skid, a self-propelled vehicle or the like. Additionally, the number of pumps powered by a directly connected drive shaft can vary according to the parameters of specific applications and environments in which pumping operations are performed. The type of pump and the type of motive unit also can be selected according to the needs of a given operation. Furthermore, various types of pump release systems can be incorporated into the system to enable selective release of one or more pumps from a given pumping operation. The pumping system 20 also can be used in many types of downhole well treatment applications and other well related operations to provide greater cost effectiveness, reliability, performance and/or other improvements to the operation.

Alternatively, the pumps 22 are mounted on a mobile platform p and the motive unit or units 24 are mounted on a separate mobile platform 30 and connected via a suitable releasable connection, as will be appreciated by those skilled in the art, which may facilitate the transportation of the pumping system 20. While, as noted above, the drive shaft 38 preferably maintains a fixed relationship between the angle of rotation of the shafts of the pumps 22 such that the pumps 22 are rotated in a synchronous manner, the gear system 50 and the pump release system 54 (the mechanical release 56, the hydraulic rerouting system 58 or similar connection between the drive shaft 38 and the pumps 22) may be connected such that the angle of rotation between the pumps 22 is selectable with respect to the other pump 22, such as from 0 to 180 degrees. The selection of the angle of rotation may be selected prior to starting the pump 22, such as by, for example, utilizing a sliding spline coupling or a jaw coupling with one or more possible engagement positions. The pump 22 is then engaged with the drive shaft 38 at the preselected rotational angle. Alternatively, the angle or rotation of the pump 22 may be varied before pumping or during pumping by inserting a suitable phase adjuster (such as, but not limited to, those commercially available from A. Fischer Phase Drives of McHenry, Ill., M.J. Vail and Company of Hillsborough, N.J., or Harmonic Drive, LLC of Peabody, Mass.), with respect to the other pump 22 and the driveshaft 38, as will be appreciated by those skilled in the art.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for pumping, comprising:

a mobile platform;

a motive unit mounted on the mobile platform;

a plurality of pumps mounted on the mobile platform;

a drive shaft forming a driveline driven by the motive unit, the drive shaft being coupled with a solid, direct connection to the plurality of pumps without splitting the driveline; and a pump release system in cooperation with the plurality of pumps to enable selective release of at least one of the plurality of pumps from delivering well treatment fluid downhole to perform at least one well treatment operation.

2. The system as recited in claim 1, wherein the motive unit comprises one of an internal combustion engine, a gas turbine, an electric motor, and a hydraulic motor.

3. The system as recited in claim 2, further comprising a transmission coupled to the internal combustion engine and to the drive shaft.

4. The system as recited in claim 1, wherein the plurality of pumps comprises two pumps.

5. The system as recited in claim 1, wherein the plurality of pumps comprises more than two pumps.

6. The system as recited in claim 1, wherein each pump of the plurality of pumps comprises a positive displacement pump.

7. The system as recited in claim 1, wherein the drive shaft extends through a first pump to a second pump.

8. The system as recited in claim 1, wherein the drive shaft comprises an external drive shaft being directly coupled to each pump of the plurality of pumps by a gear.

9. The system as recited in claim 1, wherein the pump release system is enabled to selectively release an individual pump from a pumping operation.

10. The system as recited in claim 1, wherein the mobile platform is one of a truck trailer, a skid, and a self-propelled platform.

11. A method of delivering a well treatment fluid, comprising:

providing a plurality of pumps at a well site;

coupling a single driveline directly to the plurality of pumps in series without a splitter box;

engaging the driveline with a motive unit for rotating the driveline and powering the plurality of pumps; and using a pump release system in cooperation with the plurality of pumps to enable selective release of at least one of the plurality of pumps from delivering well treatment fluid downhole to perform at least one well treatment operation.

12. The method as recited in claim 11, wherein delivering comprises delivering one of a fracturing treatment fluid, a cementing treatment fluid, and a coiled tubing service fluid.

13. The method as recited in claim 11, wherein providing comprises providing a plurality of positive displacement pumps.

14. The method as recited in claim 11, wherein coupling comprises coupling a drive shaft with a solid, direct connection to the plurality of pumps so that the drive shaft extends through at least one pump.

15. The method as recited in claim 11, wherein coupling comprises coupling a drive shaft with a solid, direct connection to the plurality of pumps so that the drive shaft is disposed externally of the plurality of pumps.

16. The method as recited in claim 11, wherein engaging comprises connecting the driveline to one of an internal combustion engine, a gas turbine, an electric motor, and a hydraulic motor.

17. The method as recited in claim 11, further comprising mounting the plurality of pumps and the motive unit on a mobile platform.

18. The method as recited in claim 11, wherein the pump release system comprises a mechanical release system.

19. The method as recited in claim 11, wherein the pump release system comprises a hydraulic rerouting system.

20. The method as recited in claim 11, further comprising at least one mobile platform, wherein the plurality of pumps and the motive unit are mounted on the mobile platform.

21. The method as recited in claim 11, further comprising at least two mobile platforms, wherein the plurality of pumps are mounted on a mobile platform and the motive unit is mounted on a separate mobile platform.

22. The method as recited in claim 11, wherein the driveline is coupled to the plurality of pumps via pinion gears.

23. The method as recited in claim 11, wherein the driveline is coupled to the plurality of pumps via a transfer case.

24. The method as recited in claim 11, wherein the pump release system comprises a plurality of valves to selectively stop flow of the treatment fluid to or from the pumps.

25. The method as recited in claim 11, wherein the pump release system is connectable such that an angle of rotation between the pumps is selectable.

26. A system, comprising:

a plurality of pumps mounted at a surface location for use in delivering treatment fluid downhole in a well treatment operation;

a motive unit;

a single shaft coupling the motive unit to the plurality of pumps without splitting the single shaft; and a pump release system in cooperation with the plurality of pumps to enable selective release of at least one of the plurality of pumps from delivering well treatment fluid downhole to perform at least one well treatment operation.

27. The system as recited in claim 26, wherein the pump release system comprises a mechanical release system.

28. The system as recited in claim 26, wherein the pump release system comprises a hydraulic rerouting system.

29. The system as recited in claim 26, further comprising at least one mobile platform, wherein the plurality of pumps and the motive unit are mounted on the mobile platform.

30. The system as recited in claim 26, further comprising at least two mobile platforms, wherein the plurality of pumps are mounted on a mobile platform and the motive unit is mounted on a separate mobile platform.

31. The system as recited in claim 26, wherein the single shaft is coupled to the plurality of pumps via pinion gears.

32. The system as recited in claim 26, wherein the single shaft is coupled to the plurality of pumps via a transfer case.

33. The system as recited in claim 26, wherein the pump release system comprises a plurality of valves to selectively stop flow of the treatment fluid to or from the pumps.

34. The system as recited in claim 26, wherein the pump release system is connectable such that an angle of rotation between the pumps is selectable.

* * * * *